United States Patent [19]

Christian

[11] 4,134,568

[45] Jan. 16, 1979

[54] PLURAL MOLDS WITH COMMON ACTUATING MEANS

[75] Inventor: Alfred W. Christian, Woodstock, Canada

[73] Assignee: Hydrotile Canada Limited, Woodstock, Canada

[21] Appl. No.: 785,336

[22] Filed: Apr. 7, 1977

[51] Int. Cl.[2] ..... B28B 7/06

[52] U.S. Cl. ..... 249/118; 249/100; 249/173; 249/219 R

[58] Field of Search ..... 249/100, 173, 219 R, 249/118; 425/440, 262

[56] References Cited

U.S. PATENT DOCUMENTS

| | | | |
|---|---|---|---|
| 270,704 | 1/1883 | Stowell | 249/173 |
| 1,290,646 | 1/1919 | Novy | 249/219 R |
| 1,336,867 | 4/1920 | Sloan | 249/173 |
| 2,306,450 | 12/1942 | Lewis | 249/118 |
| 2,684,517 | 7/1954 | Woods | 249/100 |
| 2,926,411 | 3/1960 | Steiro | 425/421 |
| 3,611,516 | 10/1971 | O'Connor et al. | 249/173 |

*Primary Examiner*—Francis S. Husar
*Assistant Examiner*—John McQuade
*Attorney, Agent, or Firm*—Burd, Braddock & Bartz

[57] ABSTRACT

A form assembly for making concrete product, as concrete pipes. The form assembly has a pair of upright outer forms comprising cylindrical jackets. The cylindrical jackets are secured to each other with connectors. First latch structures connected to the cylindrical jackets hold the jackets in closed positions. The first latch structures are movable to release positions to expand the jackets to open positions. Pallets are located in the lower ends of the jackets. Second latch structures mounted on the lower ends the jackets are operable to hold the pallets in assembled relation with the jackets. Control linkage operably connected to both the first latch structures and second latch structures is operable to sequentially operate the first and second latch structures to open and close the jackets and release and hold the pallets.

44 Claims, 8 Drawing Figures

PLURAL MOLDS WITH COMMON ACTUATING MEANS

BACKGROUND OF INVENTION

Packerhead machines for making concrete pipes are disclosed by Gourlie et al in U.S. Pat. No. 3,262,175 and Fosse et al in U.S. Pat. No. 3,551,968. These machines use outer forms and pallets in conjunction with packerheads to make concrete pipes. The packerheads are rotatably mounted on upright shafts and move upwardly in outer forms or jackets to make cylindrical concrete walls. The jackets containing the concrete pipes are transported to a curing area where the jackets are stripped from the pipes. The pipes are cured on pallets. The jackets are elongated cylindrical walls that are held in a closed position with releasable latch structures. Some jackets are three-piece arcuate segment construction as shown in U.S. Pat. No. 2,015,001. Separate lock structure is used to hold the pallets in assembled relation with the bottom ends of the jackets.

SUMMARY OF INVENTION

The invention is directed to a form structure providing an outer jacket used in making a concrete product, such as a concrete pipe. The form structure has a longitudinally split cylindrical wall held in a closed position by first releasable latch means. The first releasable latch means are movable to an open position allowing the wall to expand to facilitate stripping of the jacket from the concrete pipe. A second releasable latch means cooperates with the bell end of the jacket to hold the pallet in assembled relation with the jacket. A common control means operatively connects both the first releasable latch means and the second releasable latch means. The common control means is movable between a closed or locked position and an open or release position. On movement of the common control means from the closed position to the open position, the second latch means is released, thereby releasing the pallet from the bell end of the jacket. Continued movement of the common control means to its open position releases the first latch means whereby the cylindrical wall is expanded.

In one embodiment, the form assembly has two cylindrical jackets secured together. Each jacket has a first releasable latch means for holding the walls of the jackets in the closed position and a second releasable latch means for operatively holding the pallets in the bell ends of the jackets. The common control means operatively connects both the first and second releasable latch means of both jackets whereby a single movemet of the common control means will initially release the second latch means and thereby release the pallets from the bell ends of the jackets and then release the first latch means to expand the walls of the first and second jackets.

An object of the invention is to provide a form used to make concrete product with common control means for sequentially releasing pallet latch structures and form latch structures. A further object of the invention is to provide a form assembly with a pair of jackets having first releasable latch means for holding the jackets in closed positions and second releasable latch means for holding pallets in assembled relations in the bell ends of the jackets in combination with common control means operable to concurrently release both second latch means and then release the first latch means. Yet another object of the invention is to provide a latch mechanism for an outer form used in making concrete pipe that is reliable and durable in use, and can be used with different sized forms. These and other objects and advantages of the form assembly are shown and disclosed in the following detailed description.

DESCRIPTION OF PREFERRED EMBODIMENT

Figure 1:
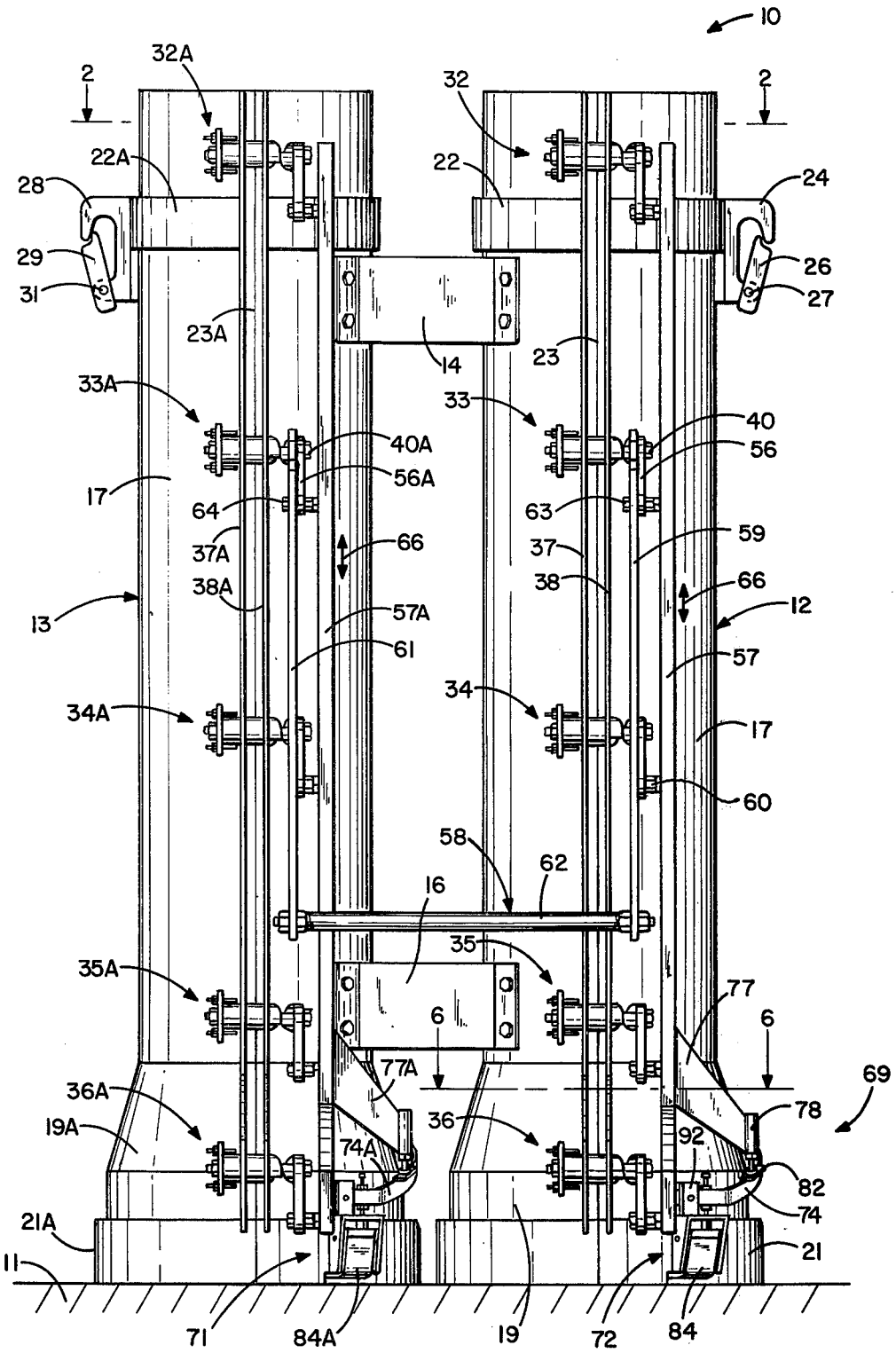
FIG. 1 is a front elevational view of the form assembly of the invention.

Referring to FIG. 1, there is shown a form assembly indicated generally at 10 used with a packerhead machine having two packerheads for simultaneously making two concrete pipes. An example of this type of machine is disclosed by applicant in his co-pending U.S. application Ser. No. 753,526 filed Dec. 22, 1976.

Form assembly 10 is supported on a horizontal surface such as a turntable 11 of a concrete pipe making machine. Form assembly 10 has a first jacket or outer form 12 and a second form or outer jacket 13. A pair of connectors 14 and 16 are secured to side portions of the jackets 12 and 13 to hold the jackets in upright side-by-side positions. Jackets 12 and 13 are identical in structure. The following description is limited to jacket 12. The corresponding parts of jacket 13 have the same reference numerals with the suffix A. One of the jackets can be used as the outer form for making concrete pipe with the packerhead machine disclosed by Gourlie et al in U.S. Pat. No. 3,262,175.

Figure 2:
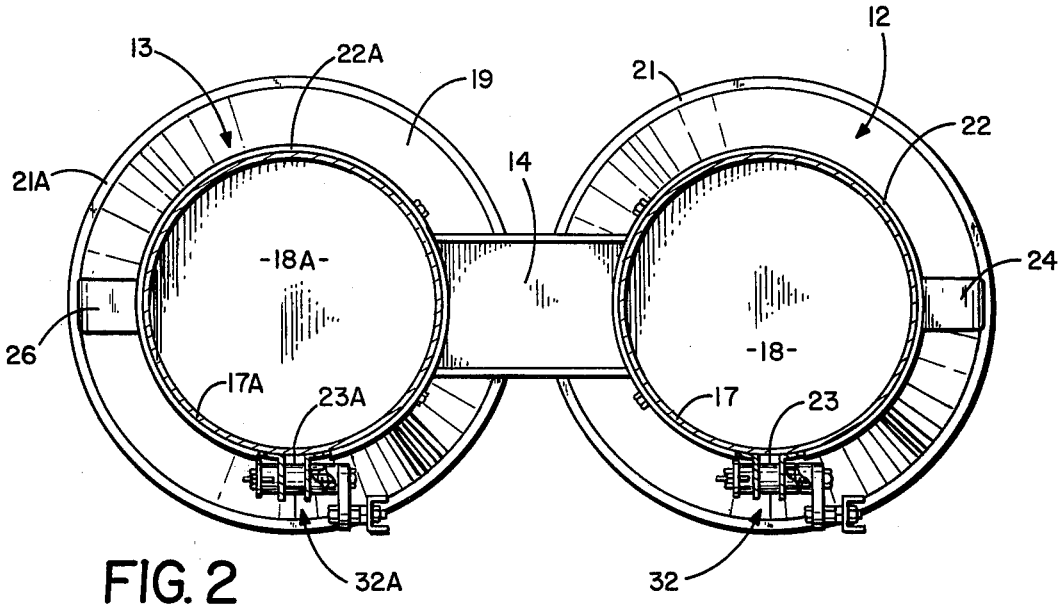
FIG. 2 is an enlarged cross sectional view taken along the line 2—2 of FIG. 1.

Referring to FIGS. 1 and 2, jacket 12 has an upright cylindrical wall 17 surrounding an elongated cylindrical chamber 18. The lower end of wall 17 is enlarged into a bell shape 19. An upper band 22 surrounds the upper portion of wall 17. Wall 17 is longitudinally split along line 23 allowing wall 17 to be moved from a closed position to an open or expanded position.

A first hook member 24 is mounted on the outside portion of band 22. Hook member 24 has a downwardly open hook that is selectively closed with a latch 26. A pivot 27 movably mounts the latch 26 on a lower portion of the hook member 24 so that the weight of the upper portion of the latch 26 will keep the latch 26 in the closed or locked position, as shown in full lines in FIG. 1.

A second hook member 28 is mounted on the outside of a portion of band 22A. Second hook member 28 has a downwardly open hook that is selectively colsed with a movable latch 29. A pin 31 pivotally mounts tha latch 29 on a lower portion of hook member 28 so that the weight of latch 29 will maintain latch 29 in the closed or locked position. Hooks or rings on suitable lifting structure cooperate with hook members 24 and 28 whereby form assembly 10 is lifted from support 11 and transported to a selected location, such as a curing area.

Figure 3:
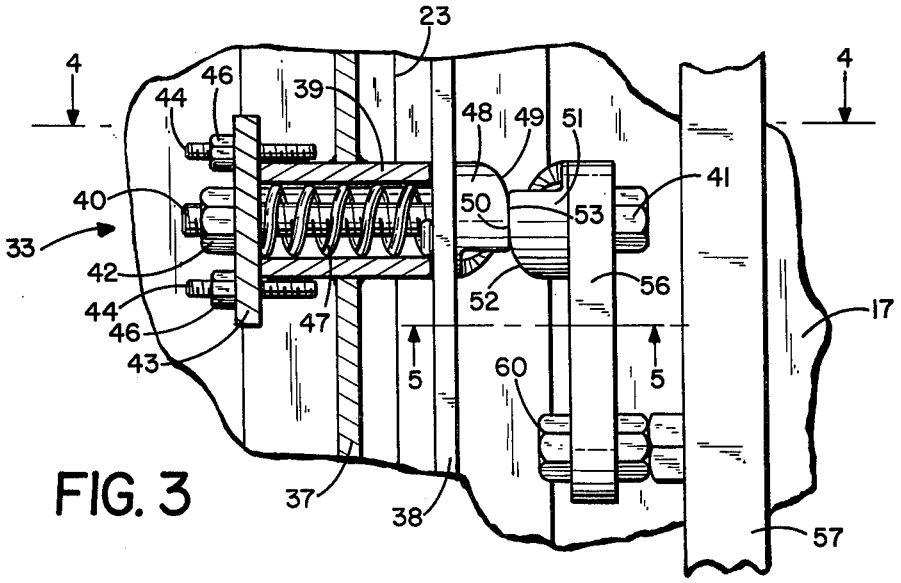
FIG. 3 is an enlarged fron elevational view, partly sectioned, of a first latch mechanism for holding the outer form in a closed position.
Figure 4:
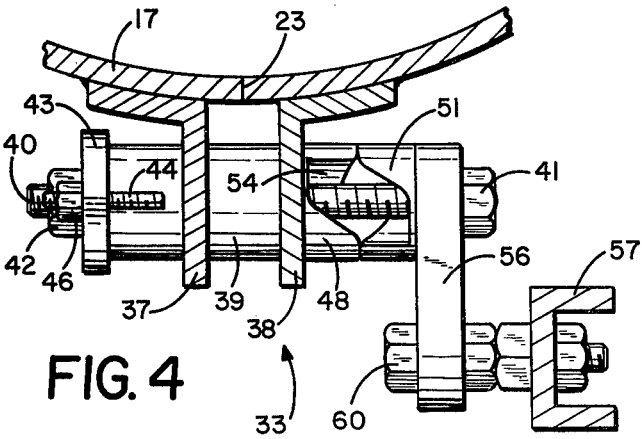
FIG. 4 is a sectional view taken along the line 4—4 of FIG. 3.
Figure 5:
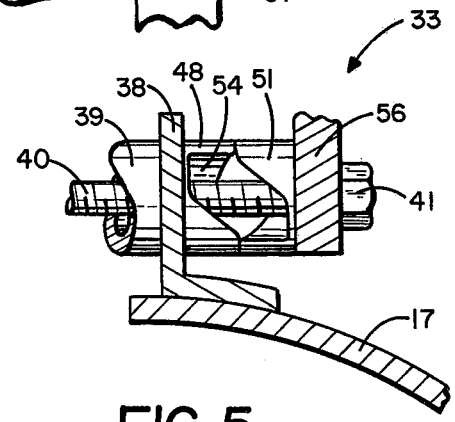
FIG. 5 is a sectional view taken along the line 5—5 of FIG. 3.

A plurality of first latching mechanisms indicated generally at 32, 33, 34, 35, and 36 are operable to hold cylindrical wall 17 in a closed position. The latching mechanisms 32–36 can be moved to a release position thereby allowing wall 17 to expand. First latching mechanisms 32–36 are identical in structure and are mounted on outwardly directed flanges 37 and 38 secured to wall 17 on opposite sides of split line 23. Flanges 37 and 38 are parts of right angle members secured by welds or the like to wall 17 adjacent opposite sides of split line 23. The following description is limited to latch mechanism 34 as shown in FIGS. 3–5.

First latching mechanism 34 has a tubular body 39 extended through a hole in and secured to flange 37 by welds of the like. One end of body 39 abuts against flange 38 whereby body 39 functions as a stop when wall 17 is in the closed position. A bolt 40 extends through body 39 and flange 38. Bolt 40 has a head 41 and is threaded into a nut 42 bearing against the outside of plate 43. Nut 42 is secured to a plate 43 bearing against the opposite end of body 39. A pair of threaded rods 44 are welded to opposite sides of body 39 and extend through holes in plate 43. Nuts 46 threaded on rods 44 hold plate 43 in engagement with body 39.

A compression spring 47 is located within body 39. One end of spring 47 bears against flange 38. The opposite end of spring 47 bears against plate 43 so that the spring biases flanges 37 and 38 away from each other, thereby biasing wall 17 to the open position.

Cylindrical wall 17 is held in the closed position by a cam means comprising a fixed cam 48 secured to flange 38 and a rotatable cam 51 rotatably mounted on bolt 40. Cam 48 has a pair of recesses or pockets 54 for accommodating portions of cam 51 when the cams have been positioned to locate wall 17 in the open position. As shown in FIGS. 3, 4, and 5, cams 48 and 51 are located in the lock or closed position wherein wall 17 is closed and the portions of wall 17 engage each other along line 23. Flat cam faces 50 and 53 are in longitudinal alignment with each other whereby cams 48 and 51 hold flange 38 in engagement with body 39. Cam 51 is secured to an outwardly directed arm 56 used to control the angular position of cam 51. Arm 56 has an outer end connected to an upright control bar 57 with a fastener 60 such as a nut and bolt assembly. Each latching mechanism 32, 33, 34, 35, and 36 has an arm similar to arm 56 attached to control bar 57 so that an upward movement of control bar 57 the cams of the latching mechanism are all moved to their release positions. The springs 47 in the latching mechanism bias wall 17 to the open position.

Both control bars 57 and 57A are moved in response to movement of a manual control structure indicated generally at 58. Manual control structure 58 comprises a first upright member 59 having an upper end secured by welds to arm 56. A second member 61 has an upper end secured to arm 56A of first latching mechanism 33A. The lower ends of members 59 and 61 a e connected to a cross bar 62. First bolt 63 secures member 59 to arm 56 and control bar 57. A second bolt 64 attaches member 61 to arm 56A of latching mechanism 33A and control bar57. The operator grabs cross bar 62 pulling it away from jackets 12 and 13. This pivots members 59 and 61 about bolts 40 and 40A of first latching mechanisms 33 and 33A moving control bars 57 and 57A in a upward direction as indicated by arrows 66. When cross bar 62 is moved toward jackets 12 and 13 control bars 57 and 57A are moved in a downward direction to rotate cams 51 of the latching mechanism to the closed or locked positions.

Figure 6:
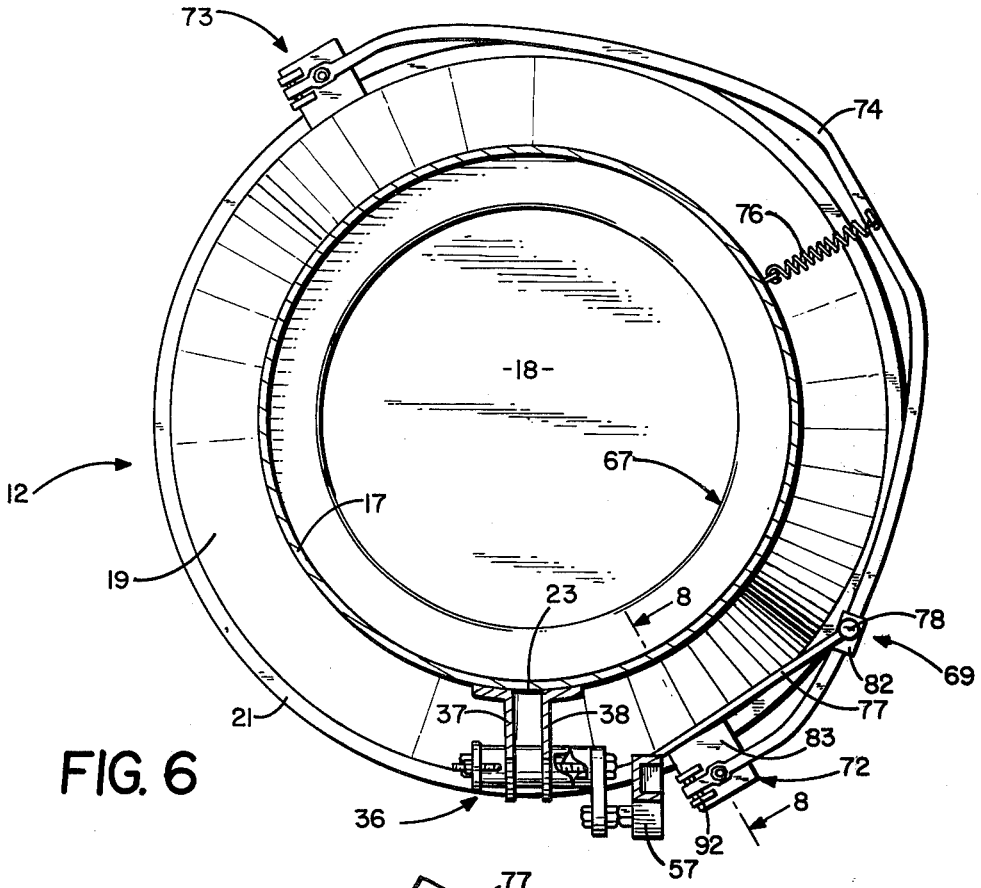
FIG. 6 is an enlarged sectional view taken along the line 6—6 of FIG. 1.
Figure 7:
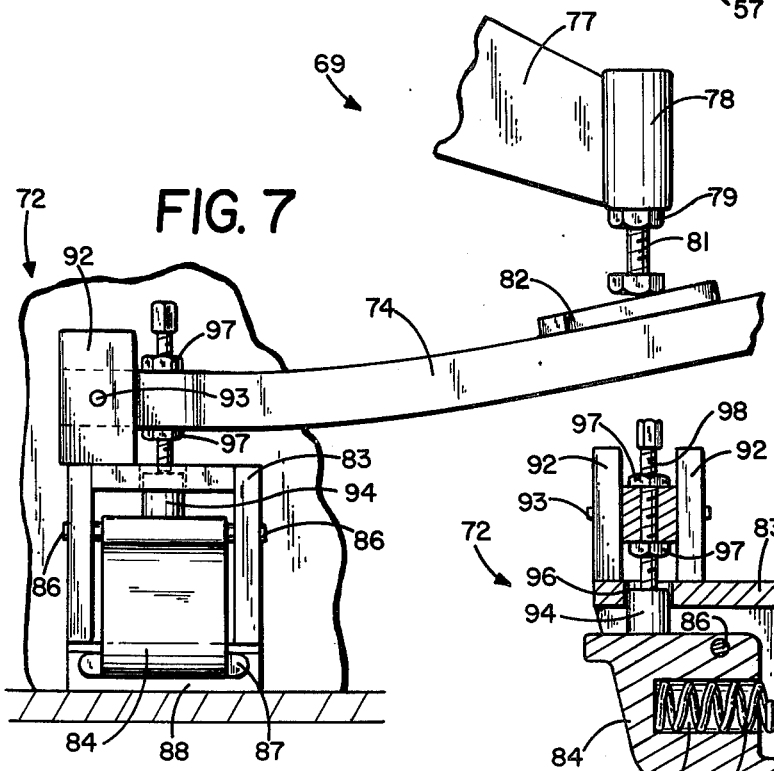
FIG. 7 is an enlarged fron elevational view of a second latching mechanism for holding a pallet in the bell of the jacket.
Figure 8:
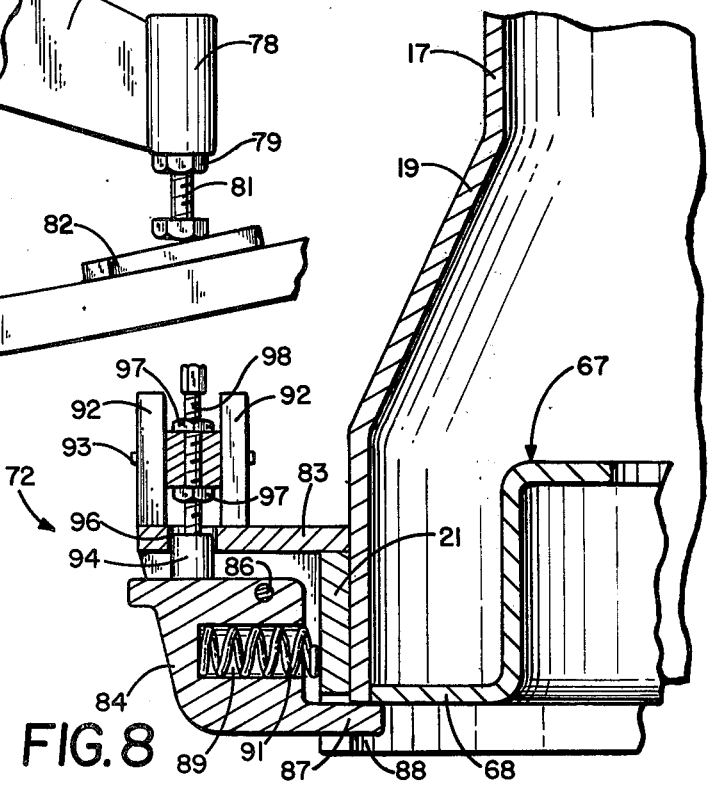
FIG. 8 is an enlarged sectional view taken along the line 8—8 of FIG. 6.

Referring to FIGS. 6 and 8, an annular pallet indicated generally at 67 is located within bell end 19 of jacket 17. Pallet 67 has an outwardly directed annular outer flange 68 located adjacent the inside wall of bell end 19. A second latching mechanism indicated generally at 69 releasably mounts pallet 67 on the bell end of jacket 17. Jacket 17A has a similar pallet which is releasably mounted on the bell end 19A with a second latching mechanism indicated generally at 71. Latching mechanism 71 is identical to the latching mechanisms of 69. Parts of latching mechanism 71 that correspond to the parts of latching mechanism 69 have the same reference numerals with the suffix A. The following description is limited to mechanism 69 as shown in FIGS. 6–8.

Locking mechanism 69 has a pair of lock units 72 and 73 located on diametric opppsite sides of band 21. A U-shaped yoke 74 extends around bell end 19 and cooperates with lock units 72 and 73 to actuate the units 72 and 73 to hold pallet 67 in assembled relation with bell end 19. Spring 76 connected to wall 17 and the center of yoke 74 biases the yoke 74 in an upward release position. Yoke 74 is moved to its down lock position by an outwardly directed arm 77 secured to control bar 57. As shown in FIG. 7, an upright sleeve 78 secured to the outer end of arm 77. Nut 79 carrying a bolt 81 projects downwardly from sleeve 78. The head end of bolts 81 engages a bearing plate 82 secured to the top of yoke 74. When control bar 57 is in the down position, yoke 74 is in its locked position so that first latching mechanisms 32–36 and second latching mechanisms 69 are both in the lock positions.

Locking unit 72 has an inverted U-shaped bracket 83 secured to band 21. A movable lock member or pawl 84 is pivotally mounted on bracket 83 with a pair of stud axles 86. Axles 86 extend through suitable aligned holes in the side portions of bracket 83. Locking member 84 has an inwardly directed shoe or projection 87. Shoe 87 extends through an opening 88 in the lower end of bell end 19 and band 21 and engages the bottom of pallet flange 68. Lock member 84 has an axial recess 89 open toward band 21. A coil compression spring 91 located in recess 89 engages band 21 and biases lock member 84 in an outward direction moving shoe 87 downwardly and out of engagement with pallet flange 68.

A pair of upwardly directed ears 92 are secured to the top of bracket 83. A transverse pin 93 pivotally connects the end of yoke 74 to ears 92. Plunger 94 extended through a hole 96 in the top of bracket 83 engages the top of lock member 84 outwardly of pivot axles 86. The pair of nuts 97 threaded on bolt or rod 98 an adjustably mounts rod 98 on yoke 74. When yoke 74 is in its down locked position, plunger 94 urges the pawl members 84 against the biasing force of spring 91 to located shoe 87 in engagement with pallet flange 68. Shoe 87 holds pallet 67 in assembled relation with bell end 19 of jacket 12. Lock unit 73 has a similar lock member or pawl that is moved into locking engagement with the opposite side of pallet 67 when yoke 74 is in the down or lock position.

Second latch mechanism 71 has a pair of lock units similar to lock units 72 and 73. Yoke 74A is engaged by the outer end of arm 77A which operates to simultaneously actuate the lock units to hold the pallet in bell end 19A of jacket 13. Arm 77A is secured to control bar 57A whereby on movement of the control bar 57A to its down position, second latch mechanism 71 is operated to hold the pallet in assembled relation with jacket end 19A.

In use, jackets 12 and 13 are placed over pallet 67 locating the pallets in bell ends 19 and 19A of the jackets. Walls 17 and 17A are moved to their closed position by operating the manual control structure 58. The operator moves cross bar 62 towards jackets 12 and 13. This rotates the rotatable cams 51 moving flanges 37, 38 and 37A, 38A toward each other closing the split in walls 17 and 17A. Arms 77 and 77A move downwardly with control bars 57 and 57A. This movement causes yokes 74 and 74A to pivot to their down lock position. Yoke 74 moves plungers 94 downwardly to pivot locking members 84 to their pallet holding positions as shown in FIG. 8.

After the concrete pipes have been formed, form assembly 10 along with the pipes therein are moved to the curing area, the operator pulls cross bar 62 away from jackets 12 and 13. During the initial movement of the arms, cams 51 ride on the flat sections of the corresponding fixed cams 48 keeping walls 17 and 17A in the closed position. The upward movement of control bars 57, 57A allow the yokes 74 and 74A to move in an upward direction. Springs 91 acting on lock members 84 bias shoes 87 of the lock members 84 out of engagement with pallet flange 68. The pallets 67 are released before the walls 17 and 17A are allowed to move to their open positions. Continued movement of cross bar 62 away from jackets 12 and 13 moves rotatable cams 51 in alignment with recesses or pockets 54 of fixed cams 48 so that springs 47 will bias walls 17 and 17A to their open positions. This facilitates the stripping of form assembly 10 from the two concrete pipes.

The common control structure for the first and second lock mechanisms can be used on a single jacket having a bell end surrounding a pallet. Cross bar 62 is removed and connectors 14 and 16 are released from jackets 12 and 13. First member 59 is used as a manual control lever for rotating levers 56 moving control bar 57 between its raised released or down locking position. Arm 77 engages yoke 74 to concurrently operate lock unit 74 ad 73.

While there has been shown and described several embodiments of the invention, it is understood that substitutions of parts, changes in the size and location of parts and materials can be made by those skilled in the art without departing from the invention. The invention is defined in the following claims.

I claim:

1. A form assembly having an end adapted to surround a pallet used to make a concrete pipe comprising: a wall surrounding a chamber, said wall having an end adapted to surround a pallet and a longitudinal slit allowing the wall to be moved to an expanded open position and to be moved to a contracted closed position, first latch means mounted on the wall selectively operable to hold the wall in the closed position and to expand the wall to the open position, said first latch means including biasing means for moving the wall to the open position, second latch means mounted on the wall selectively operable to hold the pallet on the end of the wall and to release the pallet from said end of the wall, and common control means connected to the first latch means and second latch means.

2. The form assembly of claim 1 wherein: the first latch means has cam means operable in response to movement of the common control means to a first position to move the wall to the closed position before the second latch means holds the pallet and in response to movement of the common control means from the first position to a second position to allow the second latch means to release the pallet before the wall moves to the open position.

3. The form assembly of claim 1 wherein: the first latch means includes a first member connected to a first portion of the wall adjacent one side of the slit, a second member connected to a second portion of the wall adjacent the other side of the slit and means connecting the first and second members operable to move the first and second members relative to each other to selectively move the wall to its open and closed positions.

4. The form assembly of claim 3 wherein: the first member has first cam means, and the means connecting the first member with the second member has second cam means cooperating with the first cam means to control the relative movement of the first and second members.

5. The form assembly of claim 3 wherein: the first member has first cam means, the means connecting the first member with the second member comprises a bolt and second cam means mounted on the bolt said second cam means connected to the common control means to move the first and second members relative to each other.

6. The form assembly of claim 1 wherein: the second latch means includes a first lock unit having a first locking member movable into engagement with the pallet, a second lock unit having a second locking member movable into engagement with the pallet, said first and second locking members operable to hold the pallet in the end of the wall, and means operably connected to the first and second locking members for moving the first and second locking members into engagement with the pallet.

7. The form assembly of claim 6 including: means engageable with each locking member to bias the locking members out of engagement with the pallet.

8. The form assembly of claim 6 wherein: the means operably connected to each locking member is a yoke pivotally connected to support means attached to the wall.

9. The form assembly of claim 8 including: an arm secured to the common control means and engageable with said yoke operable to move the yoke in response to movement of the common control means.

10. The form assembly of claim 1 wherein: the second latch means includes locking means movable into engagement with the pallet to hold the pallet on the end of the wall, first means engageable with the locking means for moving the locking means into engagement with the pallet and second means connecting the first means with the common control means whereby movement of the common control means results in movement of the locking means.

11. A form assembly having an end adapted to surround a pallet used to make a concrete pipe comprising: a wall surrounding a chamber, said wall having an end adapted to surround a pallet, and a longitudinal slit allowing the wall to be moved to an expanded open position and to be moved to a contracted closed position, a first flange secured to the wall adjacent one side of the slit, a second flange secured to the wall adjacent the other side of the slit, first latch means mounted on the wall selectively operable to hold the wall in the closed position and to expand the wall to the open position, said first latch means includes a first member secured to the first flange, a second member secured to the second flange, said second member engageable with the first flange when the wall is in the closed position, second latch means mounted on the wall selectively operable to hold the pallet on the end of the wall and to release the pallet from said end of the wall, means connecting the first member with the second member operable to move the first and second members relative to each other to selectively move the wall to its open and closed positions, and common control means connected to the first latch means and second latch means.

12. The form assembly of claim 11 including: biasing means engagable with the first flange and second member to move the wall to the open position.

13. The form assembly of claim 11 wherein: the first member has first cam means, the means connecting the first member with the second member comprises a bolt and second cam means mounted on the bolt, said second cam means connected to said common control means and cooperates with the first cam means to move the first and second members relative to each other.

14. The form assembly of claim 11 wherein: the second latch means includes a first lock unit having a first locking member movable into engagement with the pallet, a second locking unit having a second locking member movable into engagement with the pallet, said first and second locking members operable to hold the pallet in the end of the wall, and means operably connected to the first and second locking members for moving the first and second locking members into engagement with the pallet.

15. The form assembly of claim 14 including: means engagable with each locking member to bias the locking members out of engagement with the pallet.

16. The form assembly of claim 14 wherein: the means operably connected to each locking member is a yoke pivotally connected to support means attached to the wall.

17. The form assembly of claim 16 including: an arm secured to the common control means and engagable with said yoke operable to move the yoke in response to movement of the common control means.

18. The form assembly of claim 11 wherein: the second latch means includes locking means movable into engagement with the pallet to hold the pallet on the end of the wall, first means engagable with the locking means for moving the locking means into engagement with the pallet, and second means connecting the first means with the common control means whereby movement of the common control means results in movement of the locking means.

19. A form assembly usable to make a pair of concrete pipes comprising: a first upright cylindrical jacket, a second upright cylindrical jacket located adjacent the first jacket, means connecting the first and second jackets to each other, each jacket having a cylindrical wall surrounding a chamber, said wall having a lower end surrounding a pallet, an upright longitudinal slit allowing the wall to move to an expanded open position and to a contracted closed position, first latch means mounted on the wall selectively operable to hold the wall in the closed position and to allow the wall to expand to the open position, second latch means mounted on the wall selectively operable to engage and hold a pallet in the lower end of the wall and to disengage and release the pallet from said lower end of the wall, and common control means connected to the first and second latch means, said control means having a first position wherein the first latch means holds the walls in the closed position and the second latch means engages and holds the pallet on the lower end of the wall, and a second position wherein the first latch means allows the wall to move to the open position and the second latch means disengages from and releases the pallet, and means connecting the common control means of each jacket to concurrently operate all the control means of the jackets.

20. The form assembly of claim 19 wherein: the first latch means has cam means operable in response to movement of the common control means to the first position to move the wall to the closed position before the second latch means holds the pallet and in response to movement of the common control means from the first position to the second position to allow the second latch means to release the pallet before the wall moves to the open position.

21. The form assembly of claim 19 wherein: the first latch means includes a first member connected to a first portion of the wall adjacent one side of the slit, a second member connected to a second portion of the wall adjacent the other side of the slit, and means connecting the first and second members operable to move the first and second members relative to each other to selectively move the wall to its open and closed positions.

22. The form assembly of claim 21 wherein: the first member has a first cam means, and the means connecting the first member with the second member comprises a bolt and second cam means mounted on the bolt, said second cam means connected to the common control means, said second cam means cooperates with the first cam means to move the first and second members relative to each other.

23. The form assembly of claim 19 wherein: the second latch means includes a first lock unit having a first locking member movable into engagement with the pallet, a second lock unit having a second locking member movable into engagement with the pallet, said first and second locking members operable to hold the pallet in the end of the wall, and means operably connected to the first and second locking members for moving the first and second locking members into engagement with the pallet.

24. The form assembly of claim 23 including: means engageable with each locking member to bias the locking members out of engagement with the pallet.

25. The form assembly of claim 23 wherein: the means operably connected to each locking member is a yoke pivotally connected to support means attached to the wall.

26. The form assembly of claim 25 wherein: an arm is secured to the common control means and engageable with said yoke operable to move the yoke in response to movement of the common control means.

27. The form assembly of claim 19 wherein: the second latch means includes locking means movable into engagement with the pallet to hold the pallet on the end of the wall, first means engageable with the locking means for moving the locking means into engagement with the pallet, and second means connecting the first means with the common control means whereby movement of the common control means results in movement of the locking means.

28. A form assembly usable to make a pair of concrete pipes comprising: a first upright cylindrical jacket, a second upright cylindrical jacket located adjacent the first jacket, means connecting the first and second jackets to each other, each jacket having a cylindrical wall surrounding a pallet, an upright longitudinal slit allowing the wall to move to an expanded open position and to a contracted closed position, a first flange secured to the wall adjacent one side of the slit, a second flange secured to the wall adjacent the other side of the slit, first latch means mounted on the wall selectively operable to hold the wall in the closed position and to allow the wall to expand to the open position, said first latch means includes a first member secured to the first flange, a second member secured to the second flange, said second member engageable with the first flange when the wall is in the closed position, and means connecting the first member with the second member operable to move the first and second members relative to each other to selectively move the wall to its open and closed positions, second latch means mounted on the wall selectively operable to hold a pallet in the lower end of the wall and to release the pallet from said lower end of the wall, and common control means connected to the first and second latch means, said control means having a first position wherein the first latch means holds the walls in the closed position and the second latch means holds the pallet on the lower end of the wall, and a second position wherein the first latch means allows the wall to move to the open position and the second latch means releases the pallet, and means connecting the common control means of each jacket to concurrently operate all the control means of the jackets.

29. The form assembly of claim 28 including: biasing means engageable with the first flange and second member to move the wall to the open position.

30. The form assembly of claim 28 wherein: the second latch means includes a first lock unit having a first locking member movable into engagement with the pallet, a second locking unit having a second locking member movable into engagement with the pallet, said first and second locking members operable to hold the pallet in the end of the wall, and means operably connected to the first and second locking members for moving the first and second locking members into engagement with the pallet.

31. The form assembly of claim 30 including: means engageable with each locking member to bias the locking members out of engagement with the pallet.

32. The form assembly of claim 30 wherein: the means operably connected to each locking member is a yoke pivotally connected to support means attached to the wall.

33. The form assembly of claim 32 wherein: an arm is secured to the common control means and engageable with said yoke operable to move the yoke in response to movement of the common control means.

34. The form assembly of claim 28 wherein: the second latch means includes locking means movable into engagement with the pallet to hold the pallet on the end of the wall, first means engageable with the locking means for moving the locking means into engagement with the pallet, and second means connecting the first means with the common control means whereby movement of the common control means results in movement of the locking means.

35. A form assembly usable to make a pair of concrete pipes comprising: a first upright cylindrical jacket, a second upright cylindrical jacket located adjacent the first jacket, means connecting the first and second jackets to each other, each jacket having a cylindrical wall surrounding a chamber, said wall having a lower end surrounding a pallet, an upright longitudinal slit allowing the wall to move to an expanded open position and to a contracted closed position, first latch means mounted on the wall selectively operable to hold the wall in the closed position and to allow the wall to expand to the open position, said first latch means including biasing means for moving the wall to the open position, second latch means mounted on the wall selectively operable to hold the pallet in the lower end of the wall and to release the pallet from said lower end of the wall, and common control means connected to the first and second latch means, said control means having a first position wherein the first latch means holds the walls in a closed position and the second latch means holds the pallet on the lower end of the wall, and a second position wherein the first latch means allows the wall to move to the open position and the second latch means releases the pallet, and means connecting the common control means of each jacket to concurrently operate all of the control means of the jackets.

36. The form assembly of claim 35 wherein: the first latch means has cam means operable in response to movement of the common control means to the first position to move the wall to the closed position before the second latch means holds the pallet and in response to movement of the common control means from the first position to the second position to allow the second latch means to release the pallet before the wall moves to the open position.

37. The form assembly of claim 35 wherein: the first latch means includes a first member connected to a first portion of the wall adjacent one side of the slit, a second member connected to a second portion of the wall adjacent the other side of the slit, and means connecting the first and second members operable to move the first and second members relative to each other to selectively move the wall to its open and closed positions.

38. The form assembly of claim 37 wherein: the first member has a first cam means, and the means connecting the first member with the second member comprises a bolt and second cam means mounted on the bolt, said second cam means connected to the common control means, said second cam means cooperates with the first cam means to move the first and second members relative to each other.

39. The form assembly of claim 35 including: a first flange secured to the wall adjacent one side of the slit, a second flange secured to the wall adjacent the other side of the slit, said first latch means includes a first member secured to the first flange, a second member secured to the second flange, said second member engageable with the first flange when the wall is in the closed position, and means connecting the first member with the second member operable to move the first and second members relative to each other to selectively move the wall to its open and closed positions.

40. The form assembly of claim 35 wherein: the second latch means includes a first lock unit having a first locking member movable into engagement with the pallet, a second lock unit having a second locking member movable into engagement with the pallet, said first and second locking members operable to hold the pallet in the end of the wall, and means operably connected to the first and second locking members for moving the first and second locking members into engagement with the pallet.

41. The form assembly of claim 40 including: means engageable with each locking member to bias the locking members out of engagement with the pallet.

42. The form assembly of claim 40 wherein: the means operably connected to each locking member is a yoke pivotally connected to support means attached to the wall.

43. The form assembly of claim 42 wherein: an arm is secured to the common control means and engageable with said yoke operable to move the yoke in response to movement of the common control means.

44. The form assembly of claim 35 wherein: the second latch means includes locking means movable into engagement with the pallet to hold the pallet on the end of the wall, first means engageable with the locking means for moving the locking means into engagement with the pallet, and second means connecting the first means with the common control means whereby movement of the common control means results in movement of the locking means.

* * * * *

UNITED STATES PATENT AND TRADEMARK OFFICE

CERTIFICATE OF CORRECTION

PATENT NO. : 4,134,568

DATED : January 16, 1979

INVENTOR(S) : Alfred W. Christian

It is certified that error appears in the above-identified patent and that said Letters Patent are hereby corrected as shown below:

Column 1, line 52, "movemet" should be -- movement --.

Column 3, line 51, "mechanism" should be -- mechanisms --.

Column 3, line 68, "a" should be -- an --.

Column 5, line 46, "ad" should be -- and --.

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*